United States Patent [19]

Milliens

[11] Patent Number: 4,600,140

[45] Date of Patent: Jul. 15, 1986

[54] INTERLOCK BETWEEN PANELS

[75] Inventor: André Milliens, Etrechet, France

[73] Assignee: The Mead Corporation, Dayton, Ohio

[21] Appl. No.: 692,599

[22] Filed: Jan. 18, 1985

[30] Foreign Application Priority Data

Jan. 20, 1984 [GB] United Kingdom ..... 8401610

[51] Int. Cl.[4] ..... B65D 5/42

[52] U.S. Cl. ..... 229/48 R; 206/140; 206/427; 229/40

[58] Field of Search ..... 229/40, 48 R, 35, 36, 229/39 R; 206/427, 434, 139–161

[56] References Cited

U.S. PATENT DOCUMENTS

| | | | |
|---|---|---|---|
| 1,108,464 | 8/1914 | Morey | 229/35 |
| 1,615,200 | 1/1927 | Shrum | 229/40 |
| 2,388,288 | 11/1945 | Ringler et al. | 229/35 |
| 2,784,900 | 3/1957 | Bauer | 229/35 |
| 3,029,996 | 4/1962 | Drummond | 229/48 R |
| 3,249,284 | 5/1966 | Wood | 229/40 |
| 3,356,282 | 12/1967 | Layne, Sr. | 229/40 |
| 3,708,103 | 1/1973 | Evans | 229/35 |
| 4,106,688 | 8/1978 | Berger et al. | 229/39 R |
| 4,476,977 | 10/1984 | Manizza | 229/40 |

FOREIGN PATENT DOCUMENTS

| | | | |
|---|---|---|---|
| 2418158 | 10/1979 | France | 229/48 R |
| 555252 | 8/1943 | United Kingdom . | |

*Primary Examiner*—William Price
*Assistant Examiner*—Gary E. Elkins
*Attorney, Agent, or Firm*—Erwin Doerr

[57] ABSTRACT

An arrangement for securing together a pair of panels (10,12) comprising a locking tab (14) projecting from an end edge (16) of one of the panels (10) and a locking slit (28) provided adjacent an end edge (12*a*), of the other of the panels (12), the locking tab and the locking slit being interengaged by relative sliding movement therebetween. The locking tab includes an anchoring tab (20) hinged to one side edge of a main portion (18) of the locking tab and the locking tab sized for insertion into the locking slit when the anchoring tab has been folded into overlapping relationship with the main portion of the tab. The locking slit is formed so as to provide an abutment edge (38) which is engaged by a trailing edge (24) of the anchoring tab when the locking tab has been inserted into the locking slit, the arrangement being such that the engagement is effective to maintain the panels locked together either when the anchoring tab remains in its folded overlapping relationship with respect to the main portion or when the anchoring tab moves out of said overlapping relationship into a more upright attitude.

13 Claims, 15 Drawing Figures

INTERLOCK BETWEEN PANELS

This invention relates to panel interlocking means for securing together a pair of panels, more particularly the base panels of a wrap-around type package. The panels may, but need not be, provided by the opposite ends of a wrapper blank which are brought together and interlocked.

Locking tabs which are struck from one end of a carton wrapper and which are arranged to be driven through corresponding apertures, defined by retaining tabs, struck from an opposite end of the wrapper are well known, e;g from U.S. Pat. No. 4,093,116.

However, the present invention primarily is concerned with the interlocking of panels by causing a locking tab to be engaged by a relative sliding movement into a locking aperture.

Other types of panel interlocking means are known from U.S. Pat. Nos. 1,108,464; 3,191,845 and 3,497,924 each but the letter of which disclose locking tabs incorporating foldable 'anchoring' portions which are folded 180° into face contacting relationship with the main portion of the locking tab prior to or during engagement with a locking aperture.

One aspect of the present invention provides an arrangement for securing together a pair of panels, said arrangement comprising a locking tab projecting from an end edge of one of said panels and a locking slit provided adjacent an end edge of the other of said panels, the locking tab and the locking slit being interengaged by relative sliding movement therebetween, said locking tab including an anchoring tab hinged to one side edge of a main portion of the locking tab and the locking tab being sized for insertion into said locking slit when the anchoring tab has been folded into overlapping relationship with said main portion of the tab, characterized in that the locking slit is formed so as to provide an abutment edge on said other panel which is engaged by a trailing edge of said locking tab when the locking tab has been inserted into the locking slit, the arrangement being such that the engagement is effective to maintain the panels locked together either when the anchoring tab remains in said folded overlapping relationship with said main portion or when the anchoring tab moves out of said overlapping arrangement.

Preferably, the trailing edge of the anchoring tab has at least a portion which lies substantially parallel to the abutment edge of the locking slit when the locking tab is engaged in the locking slit and the anchoring tab remains in said folded overlapping relationship with the main portion of the tab.

Preferably, the trailing edge of the anchoring tab lies in a plane which is substantially perpendicular to the plane containing the abutment edge of the locking slit when the locking tab is engaged in the locking slit and the anchoring tab is upright with respect to the main portion of the tab.

According to another preferred feature, the fold line by which the anchoring tab is hinged to the main portion of the locking tab is inclined with respect to a notional line depicting the direction of insertion of the locking tab into the locking slit so that the edge of the locking tab provided by the fold line upon folding of the anchoring tab is convergent with respect to the opposite edge of the locking tab towards the free end of the locking tab. Preferably, the angle of inclination with respect to said notional line is substantially 15°.

According to yet another preferred feature the edge of the locking tab opposite that edge to which the anchoring tab is hinged is curvilinear.

According to a still further feature of the invention, the trailing edge of the anchoring tab may be inclined with respect to a line which is perpendicular to the notional line depicting the direction of insertion of the locking tab into the locking slit. Preferably, the angle of inclination is substantially 30°.

A number of embodiments of the invention will now be described by way of example, with reference to the accompanying drawings, in which.

Figure 4:
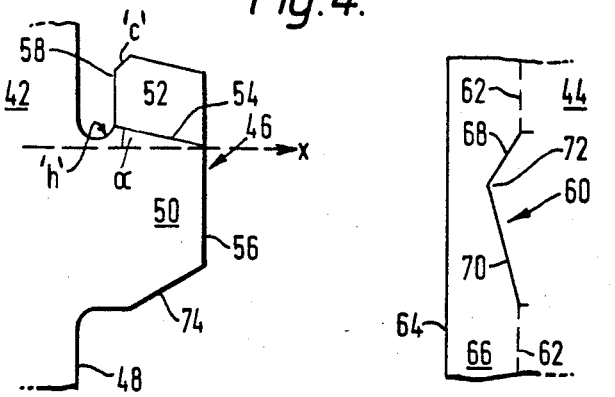
FIG. 4 shows schematically a locking tab and locking slit of modified construction prior to being interlocked.
Figure 6:
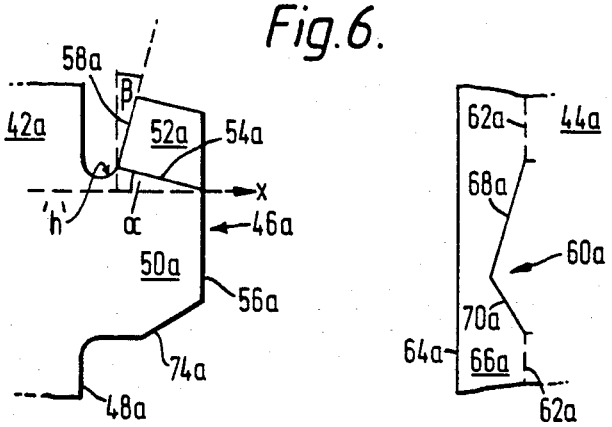
Figure 8:
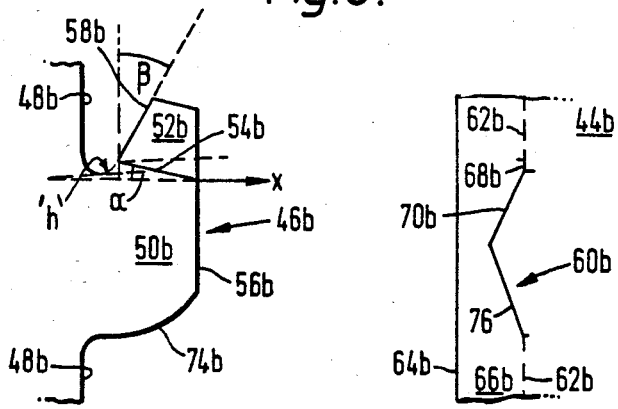
Figure 5:
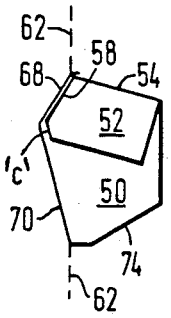
FIG. 5 shows schematically the locking tab and locking slit of FIG. 4 interlocked with the anchoring tab in folded overlapping relationship with respect to the main portion of the locking tab.
Figure 7:
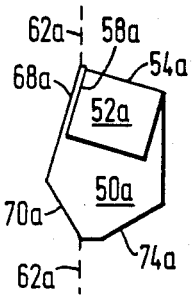
Figure 9:
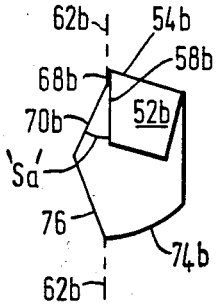
Figure 5A:
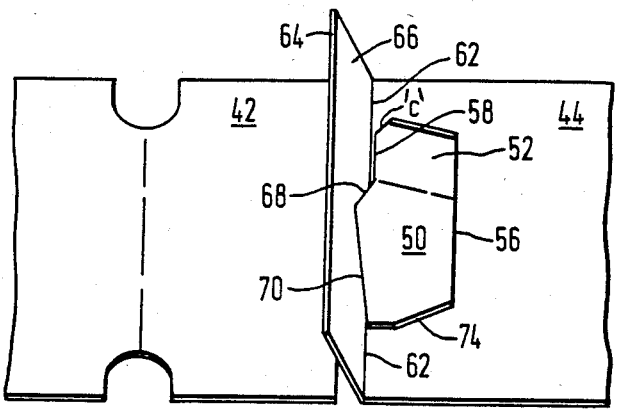
Figure 10:
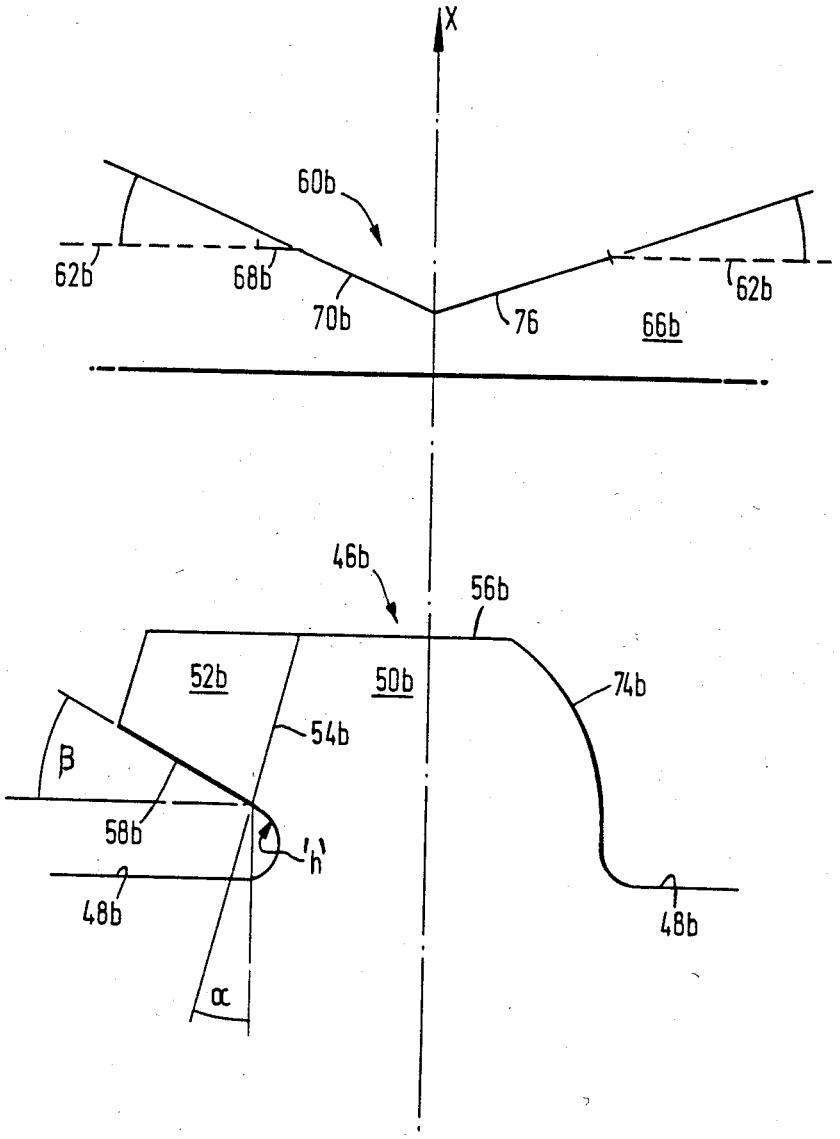
Figure 11:
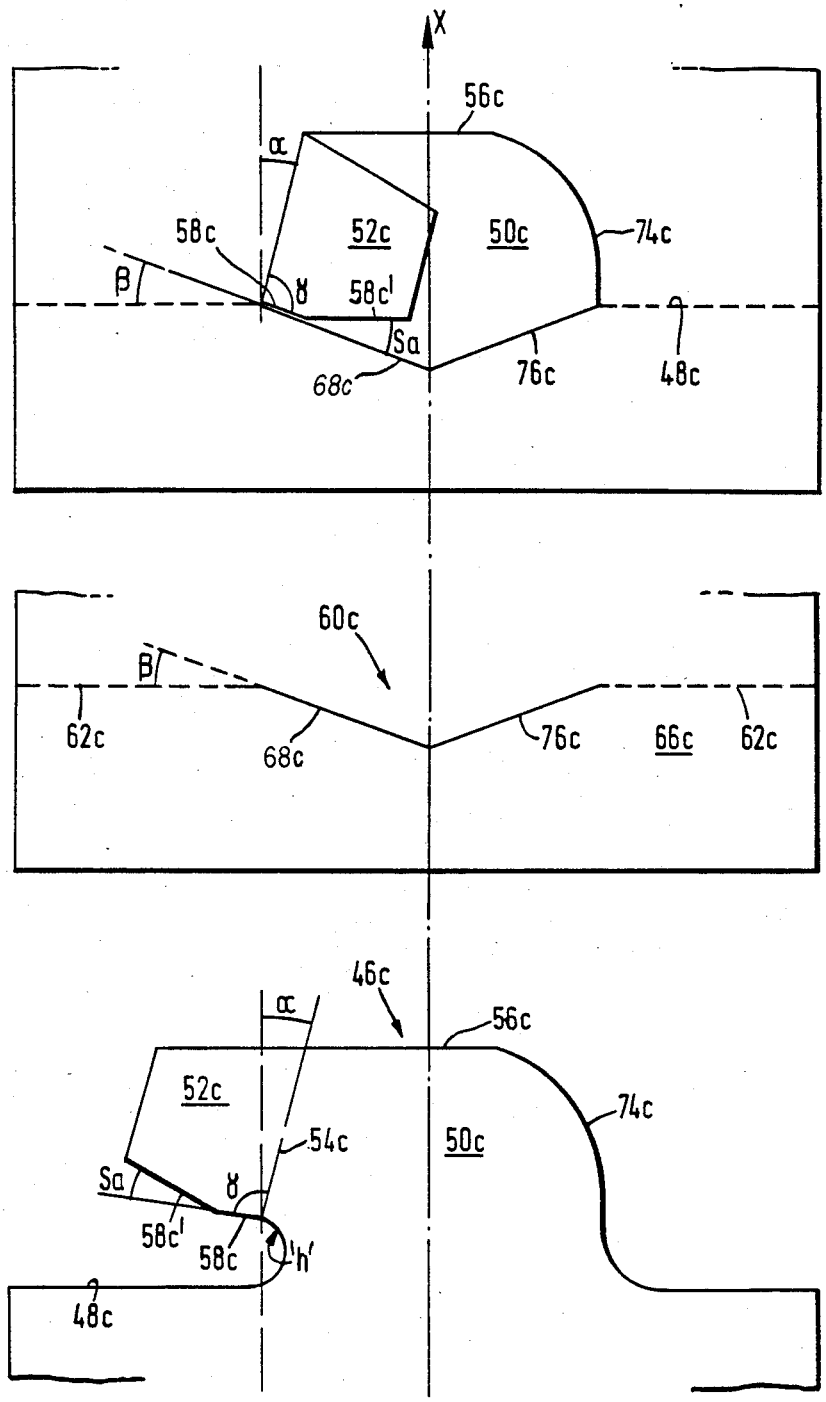
Figure 12:
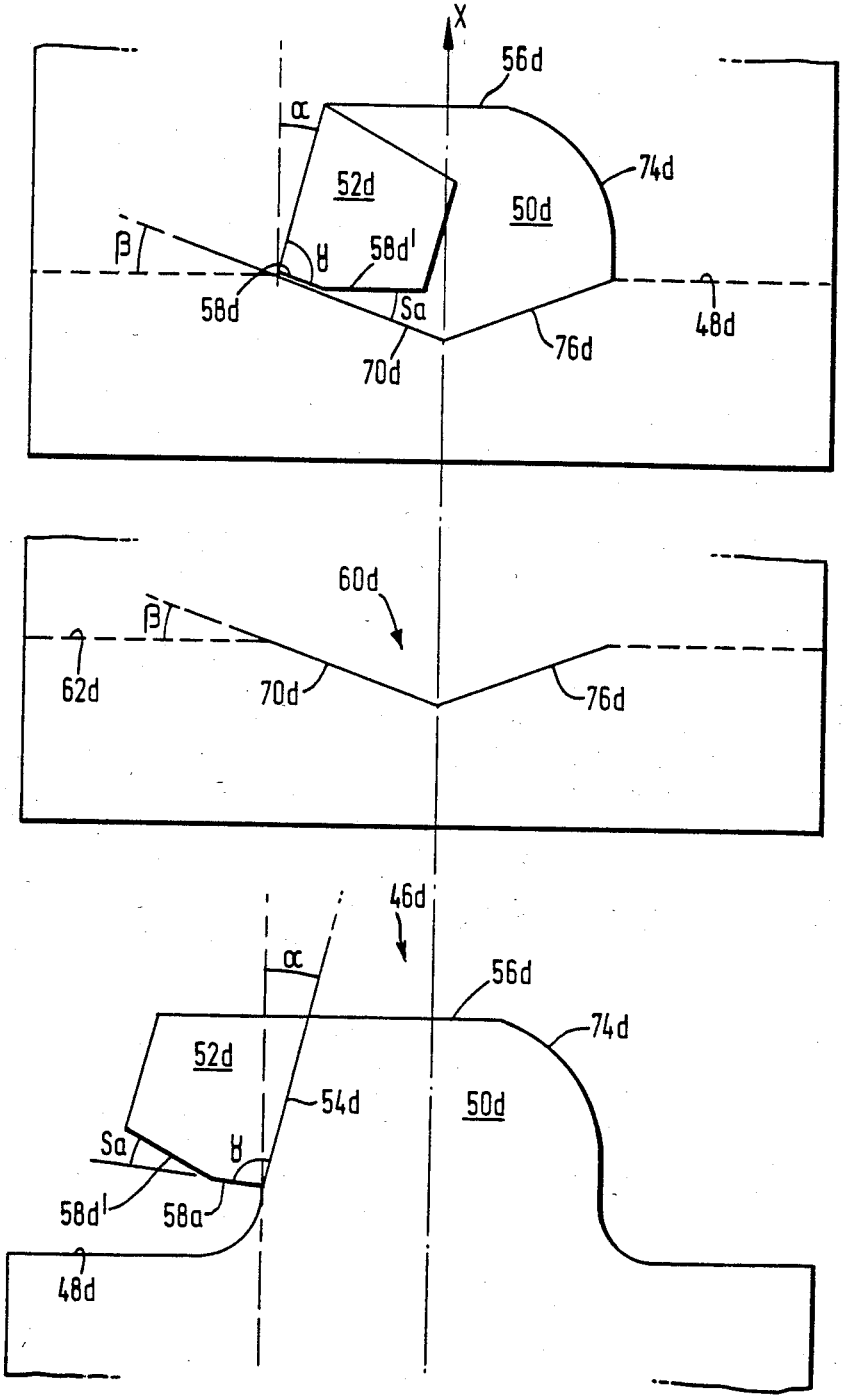
Figure 13:
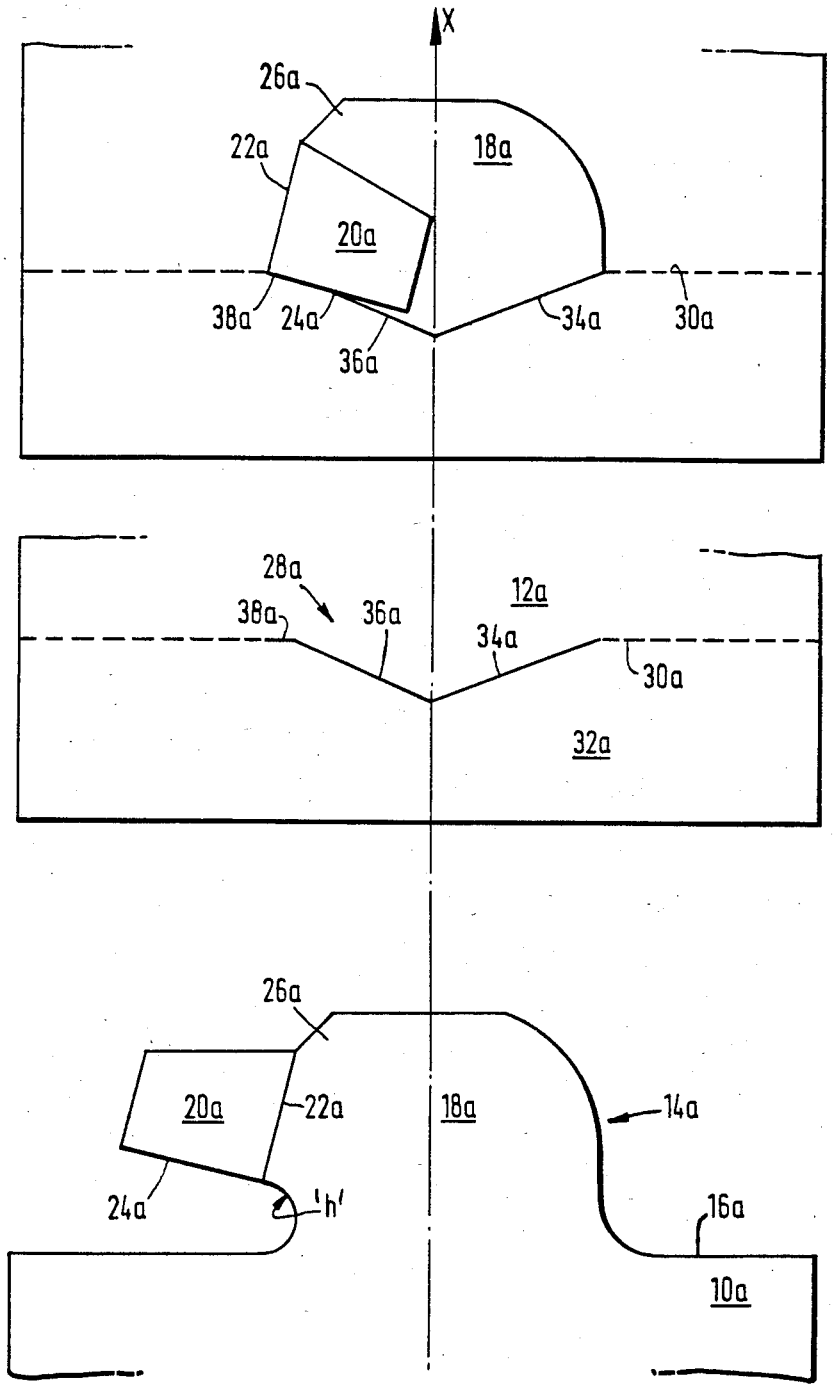
Figure 14:
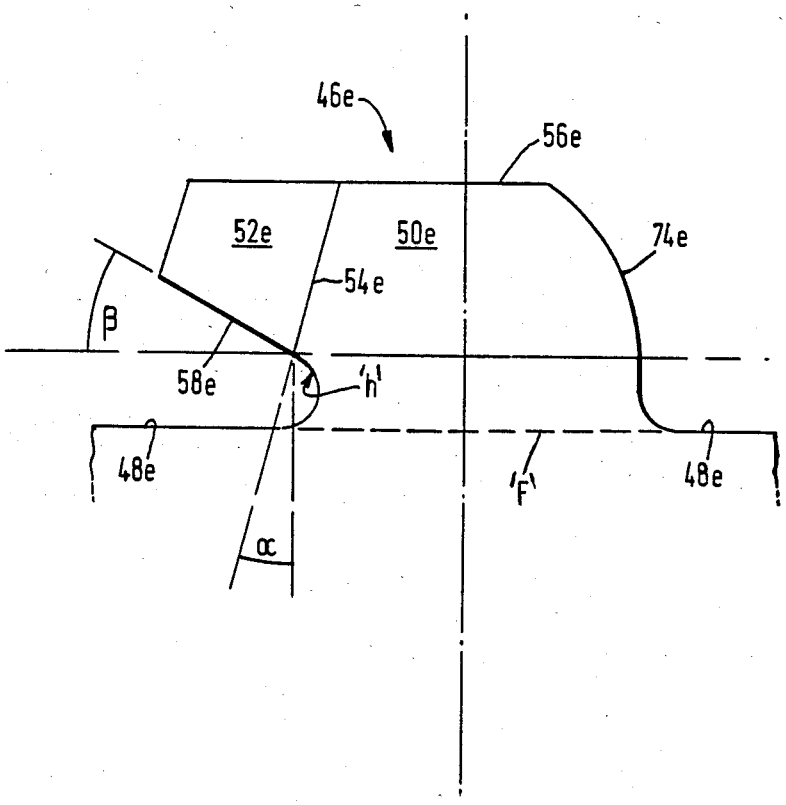

FIG. 5*a* is a perspective view from above showing the locking tab and locking slit of FIG. 4 interlocked with the anchoring tab in upright position;

FIG. 6 is similar to FIG. 4 but showing a further modified construction;

FIG. 7 is similar to FIG. 5 but showing the locking tab and locking slit of FIG. 6 interlocked;

FIG. 8 is similar to FIG. 4 but showing a still further modified and preferred construction;

FIG. 9 is similar to FIG. 5 but showing the locking tab and locking slit of FIG. 8 interlocked;

FIG. 10 shows in more specific detail the construction of the preferred form of locking tab and locking slit depicted in FIGS. 8 and 9;

FIG. 11 shows yet another modified construction depicting both the locking tab and the locking slit before, and on completion of locking;

FIG. 12 shows another modified locking tab for cooperation with the locking slit shown in FIG. 11, FIG. 13 shows a still further modified construction depicting both the locking tab and the locking slit before, and on completion of locking, and FIG. 14 shows a modification applicable to any of the locking tabs according to the invention.

Figure 1:
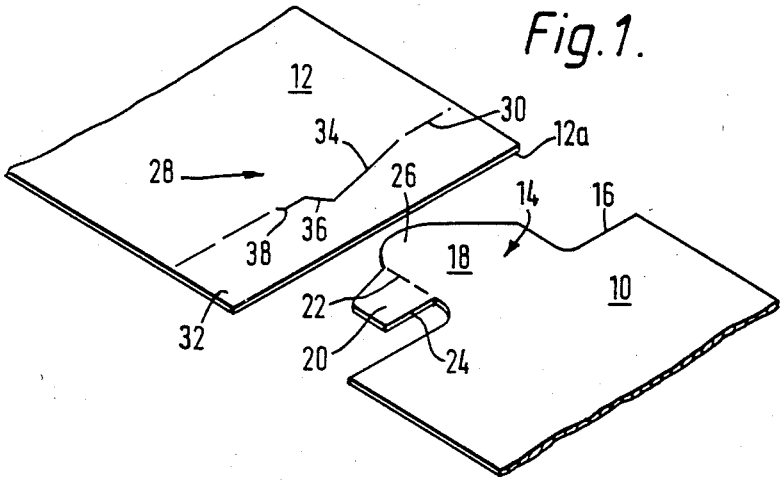
FIG. 1 shows a pair of panels, which may be opposite ends of a single wrapper blank, in close proximity, one of which includes a locking tab and the other of which includes a locking slit.
Figure 2:
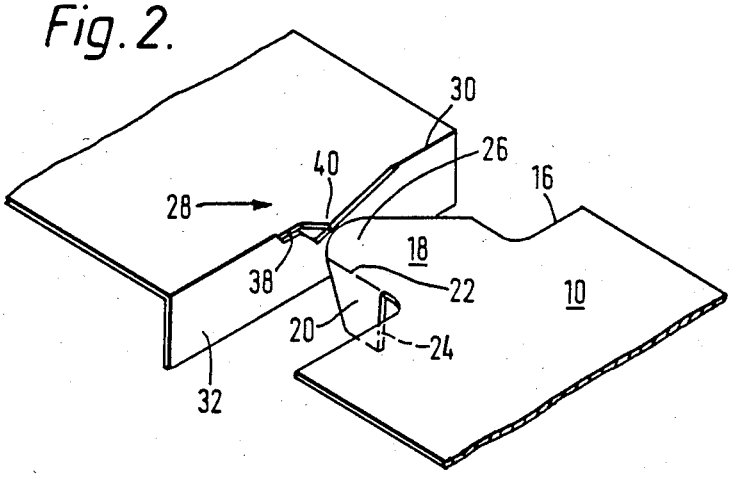
FIG. 2 is a perspective view of the panels of FIG. 1 immediately prior to being interlocked and where the anchoring tab is in an intermediate folded position.
Figure 3:
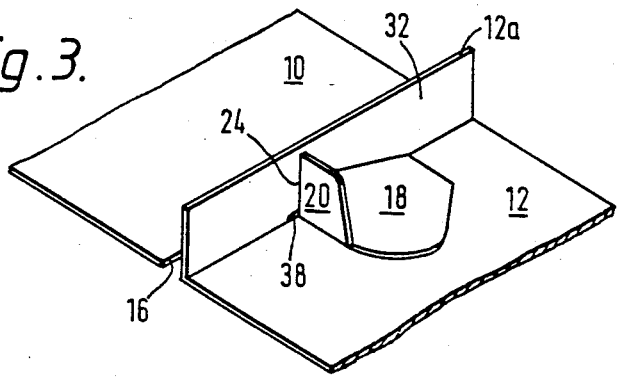
FIG. 3 shows the panels rotated through 180° and inverted from the position shown in FIG. 2 and in which the panels are interlocked with the anchoring tab in an upright position.

Referring first to FIGS. 1 to 3, a pair of panels 10, 12 respectively, are adapted to be interlocked and are formed from paperboard or similar foldable sheet material. Panel 10 includes a locking tab 14 projecting outwardly in the plane of the panel from the end edge 16. The locking tab 14 comprises a main portion 18 and an integral anchoring tab 20 which is hinged to one side edge of the main portion 18 along a fold line 22. The fold line is substantially perpendicular to the end edge 16 of panel 10. The trailing edge 24 of the anchoring tab is spaced from end edge 16 and, in use, provides a locking edge for cooperation with an abutment edge defined by a locking slit in panel 12. In this embodiment the main portion 18 is formed to include a nose 26 which projects beyond the foldable anchoring tab to lead insertion of the locking tab in a locking slit of panel 12.

Panel 12 includes a locking slit 28 in the form of a shallow "V" which is struck from panel 12 along a fold line 30 extending parallel to the end edge 12*a* of panel 12. Thus, panel 12 has a foldable front edge strip 32. The slit is formed by a continuous cut line comprising a first part 34 extending along strip 32 towards the end edge of the panel at an acute angle with respect to fold line 30; a return part 36 extending back to meet fold line 30 at an acute angle with respect thereto; and an end part 38 extending along fold line 30 which provides an abutment edge on the edge strip 32 for cooperation with the trailing edge 24 of the anchoring tab. When front edge strip 32 is folded out of the plane of the blank the slit is opened and the first and return parts 34,36 define a guide projection 40 extending outwardly from fold line 30.

In order to lock together panels 10 and 12, first the anchoring tab 20 is folded 180° about fold line 22 into face contacting relationship with the underside of the main portion 18. Also, the front edge strip 32 is folded about fold line 30 out of the plane of the blank (FIG. 2) to open the slit 28. Once the anchoring tab has been folded thus, the maximum transverse dimension (corresponding to the maximum width of the main portion) from fold line 22 to the opposite edge of the tab is sized so that the locking tab can be slidingly engaged in the locking slit 28. The locking tab may be an interference fit in the locking slit. Hence, locking tab 14 can be inserted into the slit until the trailing edge 24 of the anchoring tab has moved past, that is to say, cleared the abutment edge 38 of the locking slit. The natural resilience of the paperboard material then allows the folded anchoring tab automatically to spring back into a more upright position unless otherwise constrained whereby the trailing edge 24 at or adjacent fold line 22 is brought into a position in which it will abut against the abutment edge 38 when tension is applied to the panels in opposition to the locking direction i.e. in a direction tending to move the panels apart. Thus, the abutting engagement between edge 24 and edge 38 of the locking slit maintains the panel locked together. The projection 40 and the nose 26 of the locking tab 14 cooperate to aid in the alignment of the locking tab into the slit during locking.

In some circumstances, e.g where the panels are base panels of a packaging wrapper and packed articles are seated on the interlocked panels, both the front edge strip 32 of panel 12 and the anchoring tab 20 are flat, that is parallel to the plane of the panels. Nevertheless, the abutment between trailing edge 24 at or adjacent fold line 22 and abutment edge 38 maintains the panels interlocked. Moreover, the double-ply thickness of material provided by both the main portion 18 and anchoring tab 20 is sufficient to prevent withdrawal of the locking tab 18 from the locking slit. It will be appreciated that in this locking configuration, the trailing edge 24 lies substantially parallel to the abutment edge 38 to enhance the engagement between the panels.

Referring now to FIGS. 4,5 and 5*a* there is shown a first modified construction comprising panels 42 and 44, respectively. Panel 42 includes a locking tab 46 projecting outwardly in the plane of the panel from end edge 48. The locking tab 46 comprises a main portion 50 and an integral anchoring tab 52 which is hinged to one side edge of the main portion 50 along a fold line 54. The fold line is inclined 15° (angle ($\alpha$) ) with respect to a notional line 'X' depicting the locking direction of the locking tab. It will be seen that the line 'X' is perpendicular to the edge 48 of panel 42 and to the leading edge 56 of the locking tab. Further, the fold line 54 meets the trailing edge 58 of the anchoring tab at a location which is displaced outwardly from the base of the locking tab thus providing a hooked edge 'h' when the anchoring tab is folded. The hooked edge 'h' is provided by a trailing edge of the main portion 50 of the locking tab and either hooked edge 'h' or trailing edge 58 (or both) may provide the locking edge for cooperation with an abutment edge defined by a locking slit in panel 44.

Panel 44 includes a locking slit 60 in the form of a shallow 'V' which is struck from panel 44 along a fold line 62 extending parallel to the end edge 64 of panel 44. Thus, panel 44 has a foldable front edge strip 66. The slit 60 is formed by a continuous cut line comprising a first part 68 extending along strip 66 towards the end edge 64 of the panel at an acute angle with respect to fold line 62 and which provides an abutment edge on the edge strip 66 for cooperation with trailing edge of the locking tab, that is to say, the trailing edge 58 of the anchoring tab and/or the hooked edge 'h'. The slit 60 further includes a return part 70 extending back to meet fold line 62 at an acute angle with respect thereto. When front edge strip 66 is folded out of the plane of the blank the slit is opened and the first and return parts define a guide projection 72 projecting outwardly from fold line 62.

In order to lock together panels 42 and 44 as shown in FIGS. 5 and 5*a*, first the anchoring tab is folded 180° about fold line 62 into face contacting relationship with the main portion 50. Also, the front edge strip 66 of panel 44 is folded about fold line 62 out of the plane of the blank to open the locking slit 60. Once the anchoring tab has been folded thus, the maximum transverse dimension (corresponding to the maximum width of the main portion 50) from fold line 54 to the opposite edge 74 of the locking tab is sized so that the locking tab can be slidingly engaged in the locking slit 60. The locking tab may be an interference fit in the locking slit. It will be appreciated that the side edges of the locking tab when the anchoring tab is folded diverge towards the leading edge 56 of the locking tab thus allowing progressive engagement of the tab into the slit. Hence, the locking tab can be inserted into the slit until the trailing edge of the locking tab clears the abutment edge 68 of the slit. It will be seen that the trailing edge corner 'c' of the anchoring tab is angled so that it simultaneously clears an adjacent part of the return edge 70 of the slit.

If the anchoring tab is not otherwise constrained, the folded anchoring tab automatically will return back into a more upright position as shown in FIG. 5*a* whereby the trailing edge of the locking tab (more usually hooked edge 'h') at or adjacent fold line 54 is brought into a position in which it will abut against the abutment edge 68 of the locking slit when tension is applied to the panels in opposition to the locking direction. Thus, the abutting engagement between the trailing edge of the locking tab and abutment edge defined by the locking slit maintains the panels locked together.

In circumstances where the anchoring tab 52 remains flat it will be seen (FIG. 5 that the trailing edge 58 of the anchoring tab lies substantially parallel to the abutment edge 68 of the locking slit thus providing a positive locking engagement between the panels. In circumstances where there is transverse sliding and/or skewing of the panels relative to one another, the hooked portion 'h' of the main portion 50 adjacent trailing edge 58 engages the abutment edge 68 of the locking slit to maintain the locking relationship between the panels.

The second modified construction shown in FIGS. 6 and 7 is similar to the immediately preceding embodiment and like parts are designated like reference numerals with the addition of suffix 'a'. However, in this second modified construction the configuration of the locking slit 60*a* is reversed to give a broader abutment edge 68*a*. Consequently, the trailing edge 58*a* of the anchoring tab is given a rake angle '$\beta$' in order that it can lie substantially parallel to the abutment edge 68*a* of the locking slit when it is in folded overlapping relationship as shown in FIG. 7.

It has been found that whilst the first and second modified embodiments are satisfactory, there is a risk that locking engagement between the trailing edge of the locking tab and the abutment edge defined by the locking slit does not occur if the locking tab is not inserted sufficiently to ensure that the trailing edge clears the abutment edge. This may occur as a result of the angular edge 74/74*a* being arrested against the adjacent end of the locking slit.

Thus, the third modified construction shown in FIGS. 8 to 10 incorporates modifications to both the locking tab and locking slit as described below. In other respects this embodiment is similar to the two immediately preceding embodiments and the like parts are designated like reference numerals with the addition of suffix 'b'.

In this embodiment, the abutment edge 68*b* of the locking slit 60*b* is provided by a short cut line extending along the fold line 62*b*. In this respect the configuration of the slit more closely ressembles that of the first embodiment described with reference to FIGS. 1 to 3. Hence, slit 60*b* comprises abutment edge 68*b*, and angular cuts 70*b* and 76.

In order better to ensure full insertion of the locking tab 46*b* into the locking slit 60*b* the side edge 74*b* of the locking tab is curvilinear so that there is no sharp angular change in the configuration of the side edge.

Moreover, in order to maintain the trailing edge 58*b* of the anchoring tab parallel to the short abutment edge of the locking slit, the rank angle '$\beta$' of the trailing edge is increased. As best seen in FIG. 10, angle '$\beta$' is approximately 30°. Hence, when the anchoring tab is in folded condition with the locking tab inserted into the locking slit (FIG. 9) a portion of the trailing edge 58*b* adjacent fold line 54*b* lies parallel to the short abutment edge 68*b*. However, since the cut line 70*b* extends away from the trailing edge of the anchoring tab, a clearance or safety angle 'Sa' is present between trailing edge 58*b* and slit line 70*b*. This configuration has the advantage that the major part of the trailing edge clears the cut line 70*b* of the locking slit prior to full insertion of the locking tab earlier than in the previous embodiments whereby the likelihood of disengagement of the panels substantially is reduced.

FIG. 11 shows a further modified embodiment in which like parts of the preceding three embodiments are designated like reference numerals with the addition of suffix 'c'.

In this embodiment the trailing edge of the anchoring tab comprises two contiguous edges 58*c* and 58*c*' in which the edge 58*c* is angled so as to lie parallel to the abutment edge 68*c*. The remaining part of the trailing edge 58*c*' given a steeper rake angle so that a clearance or safety angle 'Sa' as in the immediately preceding embodiment is produced.

A general formula for producing a trailing edge of the locking tab which will engage the abutment edge of the locking slit in parallel relationship may be expressed as follows:

$$\gamma = 90° - \alpha + \beta$$

where: '$\gamma$' is the angle between that part of the trailing edge of the locking tab which is to engage the abutment edge of the locking slit and the fold line by which the anchoring tab is hinged to the main portion of the locking tab;

'$\alpha$' is the angle between a notional line depicting the locking direction of the locking tab and the fold line by which the anchoring tab is hinged to the main portion of the locking tab, and '$\beta$' is the angle between a notional extension of the abutment edge of the locking slit and a line which is perpendicular to the notional line depicting the locking direction of the locking tab.

The further modified embodiment shown in FIG. 12 is similar to the FIG. 11 embodiment and like parts are designated like reference numerals with the addition of suffix 'd'. In this embodiment the hooked 'throat' is omitted on locking tab 46*d* and in this respect the locking tab resembles that described with reference in FIGS. 1 to 3.

It has been found that on some occassions, when a deep hooked portion is provided, the anchoring tab may fold along a fold line which is displaced inwardly of the tab instead of along the correct fold line provided resulting in unreliable locking. In this embodiment the fold line 54*b* terminates at the inner edge of the trailing edge 58*d* which assists in avoiding incorrect folding of the anchoring tab 52*d*.

The embodiment shown in FIG. 13 is similar to that described with reference to FIGS. 1 to 3 and like parts are designated like reference numerals with the addition of suffix 'a'. In this modified embodiment the trailing edge 24*a* of the anchoring is given a rake angle '$\beta$' as in the embodiments described with reference to FIGS. 6 and 7. However, the abutment edge 38*a* of the locking slit is not angled so as to produce parallel abuting relationship with the traling edge 24*a* but so that the trailing edge 24*a* overlaps both the abutment edge 38*a* and a portion of the return part 36*a* of the locking slit. Thus, the abutment edge 38*a* engages the hooked part 'h' of the trailing edge of the locking tab to form a secure lock.

FIG. 14 shows a locking tab similar to that illustrated in FIG. 10 and in which like parts are designated like reference numerals but with the addition of suffix 'e'.

In this modified locking tab a transverse fold line 'F' extends across the base of the tab substantially in alignment with the free edge 48*e* of the panel from which the locking tab projects.

Fold line 'F' gives the tab more flexibility so that the tab can bend more readily to facilitate guiding the tab into a cooperating locking slit. This modification is applicable to all the locking tabs disclosed herein and it is to be understood that the location of the fold line 'F' at the base of the locking tab may not necessarily be in precise alignment with the edge 48*e*.

I claim:

1. An arrangement for securing together a pair of panels, said arrangement comprising a locking tab projecting from an end edge of one of said panels and a locking slit provided adjacent an end edge of the other of said panels, the locking tab and the locking slit being interengaged by relative sliding movement therebetween, said locking tab having a lead main portion and a trailing edge portion and including an anchoring tab hinged along a fold line to one side edge of said main portion of the locking tab and the locking tab being sized for insertion into said locking slit when the anchoring tab has been folded into overlapping relationship with said main portion of the tab, said locking slit being disposed along a fold line spaced inwardly from, and extending substantially parallel to, the end edge of said other panel and defining a foldable edge strip said locking slit and said edge strip being arranged so as to provide an abutment edge on said edge strip to be engaged by the trailing edge portion of said locking tab when the locking tab has been inserted into the locking slit.

2. The arrangement of claim 1, further characterised in that the trailing edge of the anchoring tab has at least a portion which lies substantially parallel to the abutment edge of the locking slit when the locking tab is engaged in the locking slit and the anchoring tab is in said folded overlapping relationship whith the main portion of the tab.

3. The arrangement of claim 1, further characterised in that the trailing edge of the anchoring tab lies in a plane which is substantially perpendicular to said foldable edge strip when the locking tab is engaged in the locking slit and the anchoring tab moves out of said overlapping relationship with respect to the main portion of the tab.

4. The arrangement of claim 1, further characterised in that the fold line by which the anchoring tab is hinged to the main portion of the locking tab is inclined with respect to a notional line depicting the direction of insertion of the locking tab into the locking slit so that the side edge of the locking tab provided by the fold line upon folding of the anchoring tab is convergent with respect to the opposite edge of the locking tab towards the free end of the locking tab.

5. The arrangement of claim 4, further characterised in that the angle of inclination with respect to said notional line is approximately 15°.

6. The arrangement of claim 4, further characterised in that the side edge of the locking tab opposite the edge to which the anchoring tab is hinged is curvilinear.

7. The arrangement of claim 4, further characterised in that the trailing edge of the locking tab is inclined with respect to a line which is perpendicular to the notional line depicting the direction of insertion of the locking tab into the locking slit.

8. The arrangement of claim 7, further characterised in that the angle of inclination is approximately 30°.

9. The arrangement according to claim 1, further characterised in that a fold line extends across said locking tab adjacent the end edge of said one panel from which the locking tab projects.

10. The arrangement according to claim 1, further characterised in that said locking slit is generally in the form of a shallow "V" which extends into said edge strip and interrupts said fold line.

11. The arrangement according to claim 10, further characterised in that said locking slit is assymmetrical so that the legs of said "V" are of different lengths, said abutment edge being provided by the shorter leg of the "V".

12. The arrangement according to claim 10, further characterised in that said locking slit is symmetrical so that the legs of the "V" are of substantially equal lengths.

13. The arrangement according to claim 10, further characterised in that said locking slit comprises a first part extending towards the end edge of said other panel at an acute angle with respect to said fold line, a return part extending back to meet said fold line at an acute angle with respect thereto and an end part extending substantially along said fold line and which provides said abutment edge on said edge strip.

* * * * *